US010277987B1

(12) United States Patent
Melanson

(10) Patent No.: US 10,277,987 B1
(45) Date of Patent: Apr. 30, 2019

(54) PERSONAL STATUS MONITORING USING PIEZOELECTRIC TRANSDUCER

(71) Applicant: Cirrus Logic International Semiconductor Ltd., Edinburgh (GB)

(72) Inventor: John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/822,712

(22) Filed: Nov. 27, 2017

(51) Int. Cl.
*H04R 3/00* (2006.01)
*H04R 17/02* (2006.01)
*H04R 29/00* (2006.01)

(52) U.S. Cl.
CPC ..... *H04R 17/02* (2013.01); *H04R 29/004* (2013.01); *H04R 2400/01* (2013.01)

(58) Field of Classification Search
CPC ..... H04R 3/00
See application file for complete search history.

(56) References Cited

U.S. PATENT DOCUMENTS 4,597,068 A * 6/1986 Miller ..... G01H 11/06 310/317
4,641,054 A * 2/1987 Takahata ..... H04R 17/00 310/322
8,734,296 B1 * 5/2014 Brumback ..... G06F 19/3406 482/8
2004/0203503 A1 * 10/2004 Rollins ..... G04B 25/04 455/90.3
2005/0022601 A1 * 2/2005 Blakley ..... G01N 29/022 73/612
2007/0147646 A1 * 6/2007 Klein ..... H04M 1/035 381/338
2012/0184305 A1 * 7/2012 Betts ..... G08B 13/1427 455/457
2016/0023245 A1 * 1/2016 Zadesky ..... A61B 5/7455 310/334
2016/0120466 A1 5/2016 Halperin et al.
2017/0031334 A1 * 2/2017 Medelius ..... G05D 23/1905
2017/0070834 A1 * 3/2017 Ben-Ami ..... G06K 9/00
2017/0345273 A1 * 11/2017 Lee ..... H04R 1/1083

OTHER PUBLICATIONS

Sleep Cycle alarm clock, https://www.sleepcycle.com/, copyright Northcube AB, retrieved Nov. 27, 2017.

* cited by examiner

*Primary Examiner* — Olisa Anwah
(74) *Attorney, Agent, or Firm* — Jackson Walker L.L.P.

(57) ABSTRACT

In accordance with embodiments of the present disclosure, a device may include a piezoelectric speaker for generating sound, a microphone, and a controller communicatively coupled to the speaker and the microphone. The controller may be configured to receive a first signal from the piezoelectric speaker, the first signal induced at least in part by sound incident on the speaker other than sound generated by the piezoelectric speaker, receive a second signal from the microphone, the second signal induced by sound incident on the microphone, process at least one of the first signal and the second signal to determine at least one characteristic of sound incident upon at least one of the piezoelectric speaker and the microphone, and select at least one of the microphone and the piezoelectric speaker as a signal source for incident sound based on the at least one characteristic.

15 Claims, 3 Drawing Sheets

PERSONAL STATUS MONITORING USING PIEZOELECTRIC TRANSDUCER

FIELD OF DISCLOSURE

The present disclosure relates in general to a mobile device, and more particularly, to using a piezoelectric transducer as a sensor to monitor personal status data associated with a user of a mobile device.

BACKGROUND

As successive generations of mobile devices come to market, mobile devices of a particular generation often have more features and operations than the generations that came before it. For instance, older generations of mobile devices often had limited functionality, such as for use as a telephone, while newer generations combine many features and operations in a single device, including a mobile telephone, media viewer, camera, geolocation device, and mobile computer. In addition, many newer generations of devices include monitoring of personal status information relating to vital statistics of a user of the device, such as heart rate, respiration rate, and other vital parameters.

The inclusion of such new features and functions may complicate design of devices, including form factor design for a device, as components to support such additional features may add hardware required to support such features, thus increasing size and cost of the device. Approaches are desired which add features and operations, without adding significantly to the need for additional electronic components to support such features and operations.

SUMMARY

In accordance with the teachings of the present disclosure, the disadvantages and problems associated with supporting monitoring of personal status information by a mobile device may be reduced or eliminated.

In accordance with embodiments of the present disclosure, a device may include a piezoelectric transducer and a controller communicatively coupled to the piezoelectric transducer. The controller may be configured to operate the piezoelectric transducer in a plurality of modes including at least a first mode and a second mode. In the first mode, the controller may communicate a playback signal to the piezoelectric transducer such that the piezoelectric transducer generates sound external to the device in accordance with the playback signal. In the second mode, the controller may receive a monitoring signal from the piezoelectric transducer, the monitoring signal responsive to vibration of the piezoelectric transducer caused by indicia of personal status data generated by a user of the device, and process the monitoring signal to determine personal status data of the user of the device.

In accordance with these and other embodiments of the present disclosure, a method may include in a first mode a device, communicating a playback signal to a piezoelectric transducer of the device such that the piezoelectric transducer generates sound external to the device in accordance with the playback signal. The method may also include in a second mode of the device, receiving a monitoring signal from the piezoelectric transducer, the monitoring signal responsive to vibration of the piezoelectric transducer caused by indicia of personal status data generated by a user of the device. The method may further include, in the second mode of the device, processing the monitoring signal to determine personal status data of the user of the device.

In accordance with these and other embodiments of the present disclosure, an integrated circuit may include an output configured to, in a first mode of a device, communicate a playback signal to a piezoelectric transducer of the device such that the piezoelectric transducer generates sound external to the device in accordance with the playback signal. The integrated circuit may also include an input configured to, in a second mode, receive a monitoring signal from the piezoelectric transducer, the monitoring signal responsive to vibration of the piezoelectric transducer caused by indicia of personal status data generated by a user of the device. The integrated circuit may also include a controller configured to, in the second mode, process the monitoring signal to determine personal status data of the user of the device.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
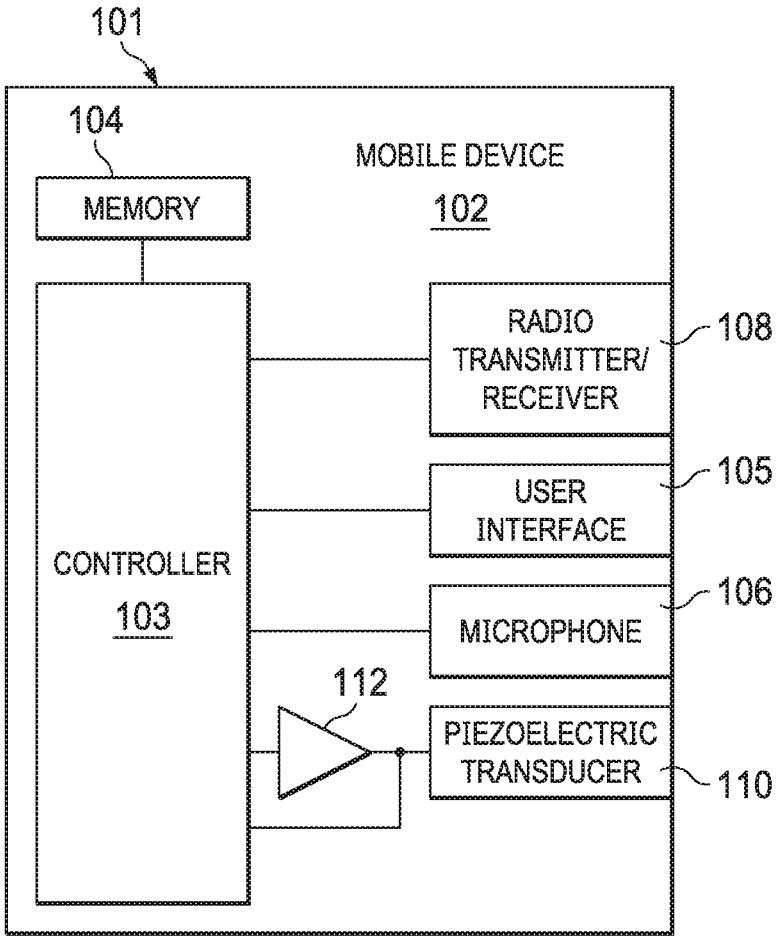
FIG. 1A illustrates a block diagram of selected components of an example mobile device, in accordance with embodiments of the present disclosure.

FIG. 1A illustrates a block diagram of selected components of an example mobile device 102, in accordance with embodiments of the present disclosure. As shown in FIG. 1A, mobile device 102 comprises an enclosure 101, a controller 103, a memory 104, a user interface 105, a microphone 106, a radio transmitter/receiver 108, a piezoelectric transducer 110, and an amplifier 112.

Enclosure 101 comprises any suitable housing, casing, or other enclosure for housing the various components of mobile device 102. Enclosure 101 may be constructed from plastic, metal, and/or any other suitable materials. In addition, enclosure 101 may be adapted (e.g., sized and shaped) such that mobile device 102 is readily transported on a person of a user of mobile device 102. Accordingly, mobile device 102 may include but is not limited to a smart phone, a tablet computing device, a handheld computing device, a personal digital assistant, a notebook computer, or any other device that may be readily transported on a person of a user of mobile device 102.

Controller 103 is housed within enclosure 101 and includes any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, controller 103 interprets and/or executes program instructions and/or processes data stored in memory 104 and/or other computer-readable media accessible to controller 103.

Memory 104 may be housed within enclosure 101, may be communicatively coupled to controller 103, and includes any system, device, or apparatus configured to retain program instructions and/or data for a period of time (e.g., computer-readable media). Memory 104 may include random access memory (RAM), electrically erasable programmable read-only memory (EEPROM), a Personal Computer Memory Card International Association (PCMCIA) card, flash memory, magnetic storage, opto-magnetic storage, or any suitable selection and/or array of volatile or non-volatile memory that retains data after power to mobile device 102 is turned off.

User interface 105 may be housed at least partially within enclosure 101, may be communicatively coupled to controller 103, and comprises any instrumentality or aggregation of instrumentalities by which a user may interact with user mobile device 102. For example, user interface 105 may permit a user to input data and/or instructions into mobile device 102 (e.g., via a keypad and/or touch screen), and/or otherwise manipulate mobile device 102 and its associated components. User interface 105 may also permit mobile device 102 to communicate data to a user, e.g., by way of a display device.

Microphone 106 may be housed at least partially within enclosure 101, may be communicatively coupled to controller 103, and comprises any system, device, or apparatus configured to convert sound incident at microphone 106 to an electrical signal that may be processed by controller 103, wherein such sound is converted to an electrical signal using a diaphragm or membrane having an electrical capacitance that varies as based on sonic vibrations received at the diaphragm or membrane. Microphone 106 may include an electrostatic microphone, a condenser microphone, an electret microphone, a microelectromechanical systems (MEMs) microphone, or any other suitable capacitive microphone.

Radio transmitter/receiver 108 may be housed within enclosure 101, may be communicatively coupled to controller 103, and includes any system, device, or apparatus configured to, with the aid of an antenna, generate and transmit radio-frequency signals as well as receive radio-frequency signals and convert the information carried by such received signals into a form usable by controller 103. Radio transmitter/receiver 108 may be configured to transmit and/or receive various types of radio-frequency signals, including without limitation, cellular communications (e.g., 2G, 3G, 4G, LTE, etc.), short-range wireless communications (e.g., BLUETOOTH), commercial radio signals, television signals, satellite radio signals (e.g., GPS), Wireless Fidelity, etc.

Piezoelectric transducer 110 may be housed at least partially within enclosure 101 or may be external to enclosure 101, may be communicatively coupled to controller 103 (e.g., via amplifier 112), and may comprise any system, device, or apparatus made with one or more materials configured to, in accordance with the piezoelectric effect, generate electric potential or voltage when mechanical strain is applied to piezoelectric transducer 110, or conversely to undergo mechanical displacement or change in size or shape (e.g., change dimensions along a particular plane) when the voltage is applied to piezoelectric transducer 110. In operation, piezoelectric transducer 110 may, in a first mode of operation of mobile device 102, responsive to audio signals communicated from controller 103 and amplified by amplifier 112, generate acoustic energy in the form of audible sound external to mobile device 102 as described in greater detail below, thus acting as an output loudspeaker for mobile device 102. In a second mode of operation of mobile device 102, piezoelectric transducer 110 may generate a monitoring signal responsive to vibration of piezoelectric transducer 110 caused by indicia of personal status data generated by a user of mobile device 102, and controller 103 may receive the monitoring signal and process the monitoring signal to determine personal status data of the user of the device, as described in greater detail below.

Although specific example components are depicted above in FIG. 1A as being integral to mobile device 102 (e.g., controller 103, memory 104, user interface 105, microphone 106, radio transmitter/receiver 108, piezoelectric transducer 110, amplifier 112), a mobile device 102 in accordance with this disclosure may comprise one or more components not specifically enumerated above.

Figure 1B:
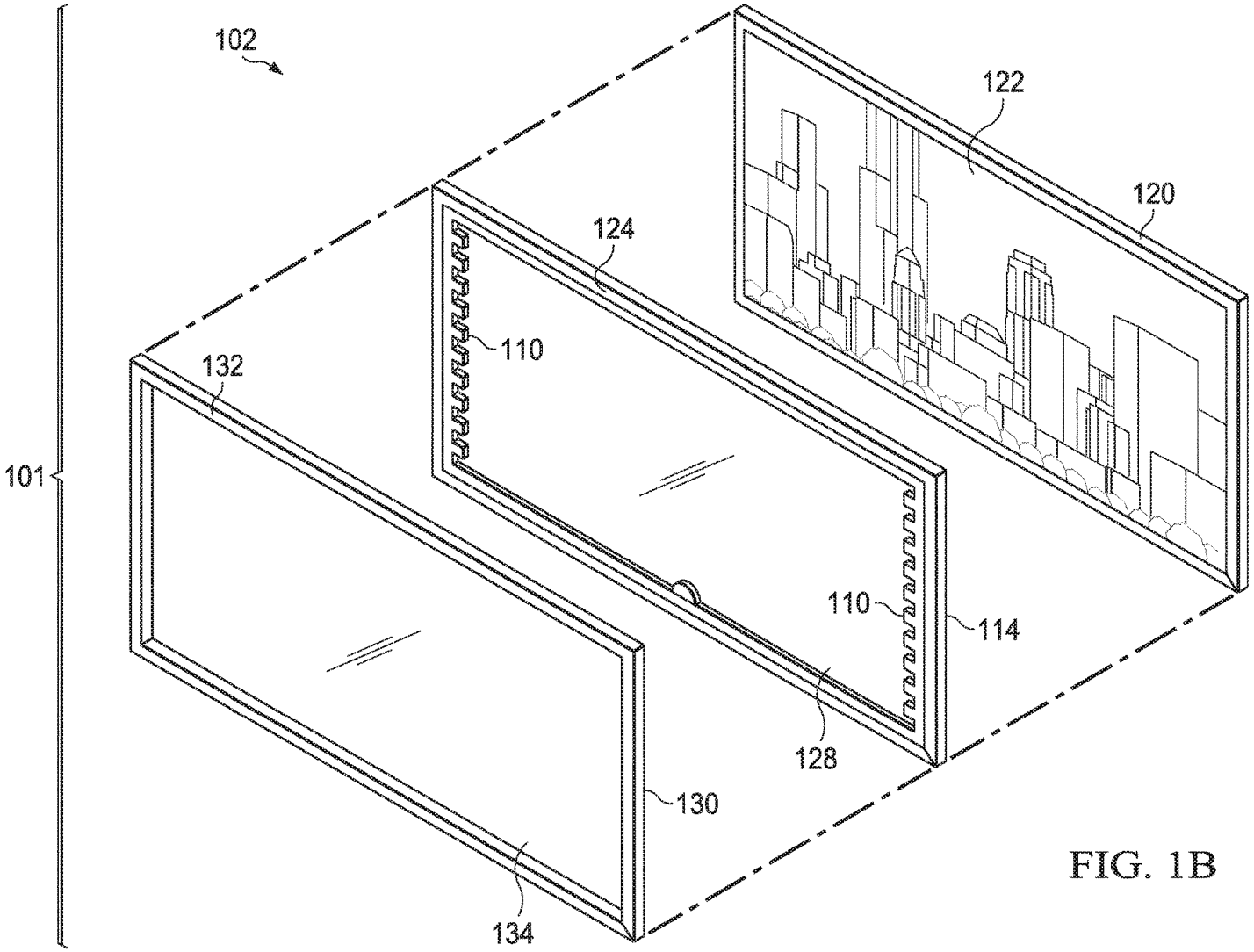
FIG. 1B illustrates an exploded perspective view of selected components of an example mobile device, in accordance with embodiments of the present disclosure.

FIG. 1B illustrates an exploded perspective view of selected components of example mobile device 102, in accordance with embodiments of the present disclosure. As shown in FIG. 1B, enclosure 101 may include a main body 120, a piezoelectric transducer assembly 114, and a cover assembly 130, such that when constructed, piezoelectric transducer assembly 114 is interfaced between main body 120 and cover assembly 130. Main body 120 may house a number of electronics, including controller 103, memory 104, radio transmitter/receiver 108, and/or microphone 106, as well as a display (e.g., a liquid crystal display) of user interface 105.

Piezoelectric assembly 114 may comprise a frame 124 configured to hold and provide mechanical structure for one or more piezoelectric transducers 110 (which may be coupled to controller 103) and transparent film 128. In a first mode of operation of mobile device 102, piezoelectric transducers 110 may, responsive to audio signals communicated from controller 103, cause vibration in transparent film 128, which in turn may generate acoustic energy in the form of audible sound external to mobile device 102. Additionally, the transparent nature of transparent film 128 may allow display 122 to be viewed through cover 130 and piezoelectric transducer assembly 114.

Cover assembly 130 may comprise a frame 132 configured to hold and provide mechanical structure for transparent cover 134. Transparent cover 134 may be made from any suitable material (e.g., ceramic) that allows visibility through transparent cover 134, protection of piezoelectric transducer 110 and display 122, and/or user interaction with display 122.

In a second mode of operation, acoustical, subsonic, or ultrasonic energy incident on transparent film 128 causes motion (e.g., vibration) of transparent film 128, which may in turn, in accordance with the piezoelectric effect, induce a voltage within one or more piezoelectric transducers 110, which may be sensed and transmitted to controller 103 and/or other circuitry for processing, effectively operating as a sensor for sensing personal status information associated with a user of mobile device 102, as described in greater detail below.

Figure 2:
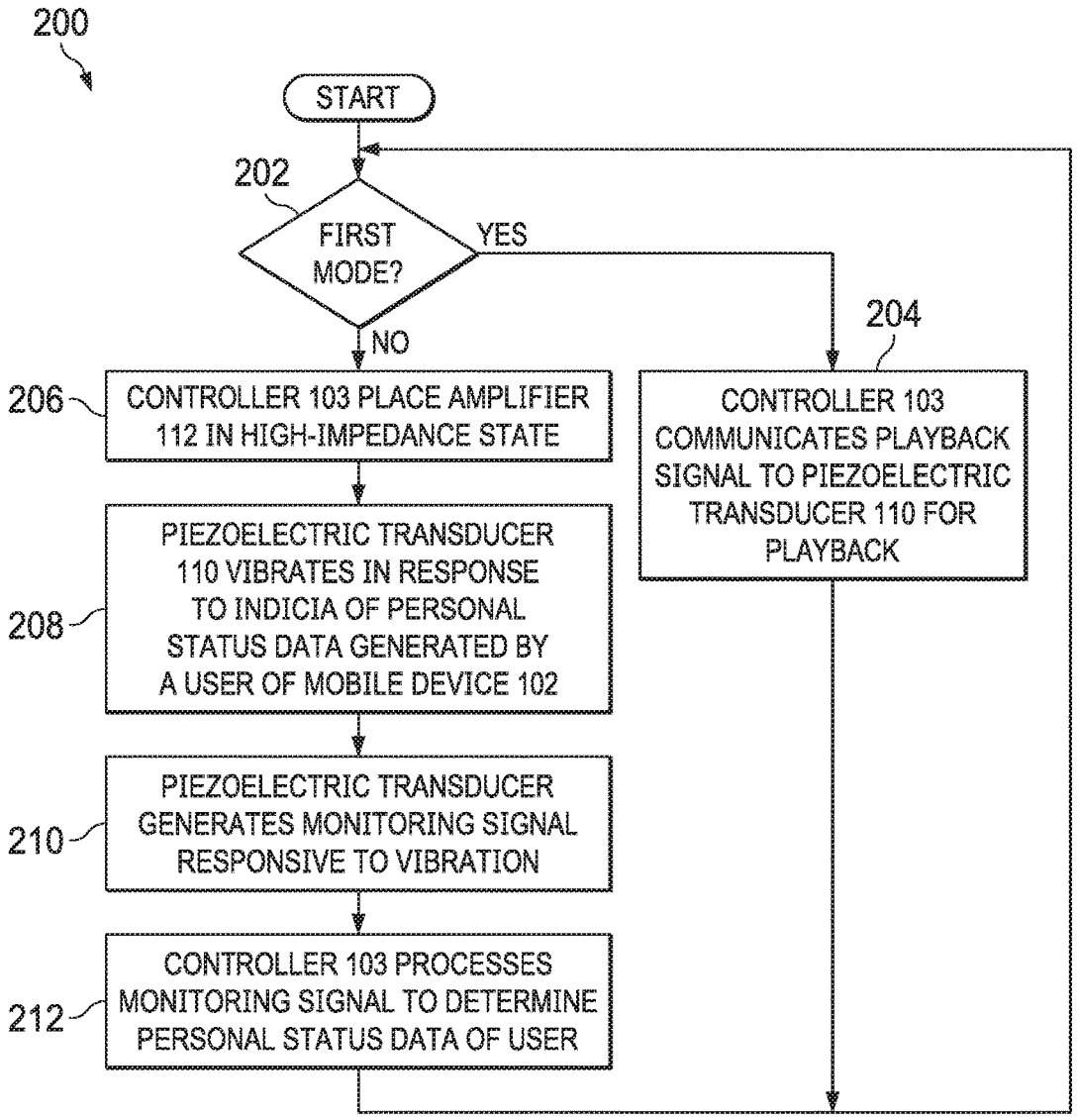
FIG. 2 illustrates a flow chart of an example method for using a piezoelectric transducer to monitor personal status data of a user, in accordance with embodiments of the present disclosure.

FIG. 2 illustrates a flow chart of an example method 200 for using a piezoelectric transducer to monitor personal status data of a user, in accordance with embodiments of the present disclosure. According to one embodiment, method 200 begins at step 202. As noted above, teachings of the present disclosure are implemented in a variety of configurations of mobile device 102. As such, the preferred initialization point for method 200 and the order of the steps comprising method 200 may depend on the implementation chosen.

At step 202, controller 103 may determine whether to operate mobile device 102 in a first mode in which piezoelectric transducer 110 is used for sound output, or a second mode in which piezoelectric transducer 110 is used to monitor personal status information of a user of mobile device 102. Such determination of operational mode may be determined in any suitable fashion. For instance, if mobile device 102 is being used for a telephonic call and/or being used to play sound in connection with an application executing on mobile device 102, controller 103 may operate mobile device 102 in the first mode and proceed to step 204. However, in the absence of audio program information being output by controller 103 for playback on piezoelectric transducer 110, controller 103 may operate mobile device 102 in the second mode and proceed to step 206.

At step 204, in the first mode, controller 103 may communicate a playback signal (e.g., internal audio or downlink speech) to piezoelectric transducer 110 such that piezoelectric transducer 110 generates sound external to mobile device 102 in accordance with the playback signal. After completion of step 204, method 200 may proceed again to step 202.

At step 206, in the second mode, controller 103 may place amplifier 112 in a high-impedance state in any suitable manner, including disabling a switch between the output of amplifier 112 and piezoelectric transducer 110 or otherwise disabling amplifier 112 such that amplifier 112 does not drive a signal to piezoelectric transducer 110, thus allowing controller 103 to receive a monitoring signal as a voltage signal from piezoelectric transducer 110.

At step 208, piezoelectric transducer 110 may vibrate in response to indicia of personal status data generated by a user of mobile device 102. Indicia of personal status data may include any physical quantity, including without limitation subsonic vibrational energy, acoustical vibrational energy, supersonic vibrational energy, and/or mechanical motion, voluntarily or involuntarily generated by the user which is detectible by piezoelectric transducer. Such personal status data may include a physical vital statistic of the user, such as, for example, a heart rate, respiration rate, presence of motion, rate of motion, presence of snoring of the user, or any other physical process of the user that causes vibrational energy and/or mechanical motion of piezoelectric transducer 110.

At step 210, piezoelectric transducer 110 may generate a monitoring signal responsive to vibration of the piezoelectric transducer caused by indicia of personal status data generated by a user of the device in accordance with the piezoelectric effect and controller 103 may receive such signal.

At step 212, controller 103 may process the monitoring signal to determine personal status data of the user of the device. For example, certain characteristics of the monitoring signal may have characteristics (e.g., magnitudes, frequencies) indicative of one or more particular physical processes, and controller 103 may perform one or more analyses of the monitoring signal to determine which indicia of personal status information exists within the monitoring signal. For example, to determine a heart rate, controller 103 may perform bandpass filtering within the range of heart signals, and perform signal correlation to determine a heart rate. As another example, to determine a respiratory rate, controller 103 may perform processing in a similar manner to that disclosed in U.S. Pat. No. 8,734,360. After completion of step 212, method 200 may proceed again to step 202.

Although FIG. 2 discloses a particular number of steps to be taken with respect to method 200, method 200 may be executed with greater or fewer steps than those depicted in FIG. 2. In addition, although FIG. 2 discloses a certain order of steps to be taken with respect to method 200, the steps comprising method 200 may be completed in any suitable order.

Method 200 may be implemented using mobile device 102 or any other system operable to implement method 200. In certain embodiments, method 200 may be implemented partially or fully in software and/or firmware embodied in computer-readable media (e.g., memory 104) and executable by a controller (e.g., controller 103).

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A device comprising:

a piezoelectric transducer; and a controller communicatively coupled to the piezoelectric transducer and configured to operate the piezoelectric transducer in a plurality of modes including at least:

a first mode in which the controller is configured to communicate a playback signal to the piezoelectric transducer via an amplifier such that the piezoelectric transducer is configured to generate sound external to the device in accordance with the playback signal; and a second mode in which the controller is configured to:

place the amplifier in a high-impedance state such that the amplifier is unable to communicate the playback signal to the piezoelectric transducer;

receive a monitoring signal from the piezoelectric transducer, the monitoring signal responsive to vibration of the piezoelectric transducer caused by indicia of personal status data generated by a user of the device; and process the monitoring signal to determine personal status data of the user of the device.

2. The device of claim 1, wherein the personal status data comprises a physical vital statistic of the user.

3. The device of claim 2, wherein the physical vital statistic includes at least one of a heart rate, respiration rate, presence of motion, rate of motion, and presence of snoring of the user.

4. The device of claim 1, wherein the controller is further configured to, in the second mode:

receive the monitoring signal as a voltage signal induced by interaction of the indicia of the personal status data with the piezoelectric transducer.

5. A method comprising:

in a first mode of a device, communicating a playback signal to a piezoelectric transducer of the device via an amplifier such that the piezoelectric transducer generates sound external to the device in accordance with the playback signal; and in a second mode of the device:

placing the amplifier in a high-impedance state such that the amplifier is unable to communicate the playback signal to the piezoelectric transducer;

receiving a monitoring signal from the piezoelectric transducer, the monitoring signal responsive to vibration of the piezoelectric transducer caused by indicia of personal status data generated by a user of the device; and processing the monitoring signal to determine personal status data of the user of the device.

6. The method of claim 5, wherein the personal status data comprises a physical vital statistic of the user.

7. The method of claim 6, wherein the physical vital statistic includes at least one of a heart rate, respiration rate, presence of motion, rate of motion, and presence of snoring of the user.

8. The method of claim 5, further comprising, in the second mode:

receiving the monitoring signal as a voltage signal induced by interaction of the indicia of the personal status data with the piezoelectric transducer.

9. An integrated circuit comprising:

an output configured to, in a first mode of a device, communicate a playback signal to a piezoelectric transducer of the device via an amplifier such that the piezoelectric transducer is configured to generate sound external to the device in accordance with the playback signal;

an input configured to, in a second mode of the device, receive a monitoring signal from the piezoelectric transducer, the monitoring signal responsive to vibration of the piezoelectric transducer caused by indicia of personal status data generated by a user of the device; and a controller configured to, in the second mode of the device, place the amplifier in a high-impedance state such that the amplifier is unable to communicate the playback signal to the piezoelectric transducer, and process the monitoring signal to determine personal status data of the user of the device.

10. The integrated circuit of claim 9, wherein the personal status data comprises a physical vital statistic of the user.

11. The integrated circuit of claim 10, wherein the physical vital statistic includes at least one of a heart rate, respiration rate, presence of motion, rate of motion, and presence of snoring of the user.

12. The integrated circuit of claim 9, the controller further configured to, in the second mode:

receive the monitoring signal as a voltage signal induced by interaction of the indicia of the personal status data with the piezoelectric transducer.

13. The device of claim 1, wherein the high-impedance state is an off state.

14. The method of claim 5, wherein the high-impedance state is an off state.

15. The integrated circuit of claim 9, wherein the high-impedance state is an off state.

* * * * *